US008227698B2

(12) United States Patent
Czyzewski et al.

(10) Patent No.: US 8,227,698 B2
(45) Date of Patent: Jul. 24, 2012

(54) INSULATING STRUCTURE WITH SCREENS SHAPING AN ELECTRIC FIELD

(75) Inventors: Jan Czyzewski, Cracow (PL); Jens Rocks, Freienbach (CH); Norbert Koch, Dietikon (CH); Przemyslaw Burzynski, Cracow (PL)

(73) Assignee: ABB Research Ltd, Zurich (CH)

( * ) Notice: Subject to any disclaimer, the term of this patent is extended or adjusted under 35 U.S.C. 154(b) by 520 days.

(21) Appl. No.: 12/520,988

(22) PCT Filed: Dec. 19, 2007

(86) PCT No.: PCT/EP2007/011042

§ 371 (c)(1),
(2), (4) Date: Jun. 24, 2009

(87) PCT Pub. No.: WO2008/080547

PCT Pub. Date: Jul. 10, 2008

(65) Prior Publication Data

US 2010/0018751 A1 Jan. 28, 2010

(30) Foreign Application Priority Data

Dec. 28, 2006 (EP) ..... 06460047

(51) Int. Cl.
*H01B 17/28* (2006.01)

(52) U.S. Cl. ..... 174/143; 174/152 R; 174/142; 174/137 R

(58) Field of Classification Search ..... 174/152 R, 174/142, 73.1, 74 R, 76, 77 R, 80, 137, 143, 174/138, 11 BH, 12 BH, 14 BH, 650, 18; 16/2.1, 2.2; 248/56; 439/274, 275; 385/138; 337/202

See application file for complete search history.

(56) References Cited

U.S. PATENT DOCUMENTS

| | | | | | |
|---|---|---|---|---|---|
| 3,271,509 | A * | 9/1966 | Calderwood et al. | ..... | 174/143 |
| 3,513,253 | A * | 5/1970 | Woods | ..... | 174/143 |
| 3,647,938 | A * | 3/1972 | Grimmer | ..... | 174/143 |
| 3,769,447 | A * | 10/1973 | Quirk et al. | ..... | 174/143 |
| 3,875,327 | A * | 4/1975 | Hildenbrand | ..... | 174/143 |
| 3,967,051 | A * | 6/1976 | Moore et al. | ..... | 174/143 |
| 4,338,487 | A | 7/1982 | Matsuo | ..... | 174/143 |
| 4,362,897 | A | 12/1982 | Matthaus et al. | ..... | 174/31 R |
| 4,387,266 | A | 6/1983 | Matthaus | ..... | 174/31 R |
| 4,500,745 | A | 2/1985 | Miggins | ..... | 174/31 R |
| 8,003,891 | B2 * | 8/2011 | Rocks et al. | ..... | 174/142 |

FOREIGN PATENT DOCUMENTS

| | | |
|---|---|---|
| GB | 877055 | 9/1961 |
| GB | 991546 | 5/1965 |
| GB | 1125964 | 9/1968 |
| JP | 1283716 | 11/1989 |
| WO | WO 2006/001724 A1 | 1/2006 |

* cited by examiner

*Primary Examiner* — Angel R Estrada

(74) *Attorney, Agent, or Firm* — Renner Kenner Greive Bobak Taylor & Weber

(57) ABSTRACT

The subject of the invention is an insulating structure with screens shaping the electric field, applicable in high-voltage bushings, high-voltage cables, cable accessories and in measuring instruments, especially instrument transformers. The structure according to the invention comprising layers of electrically insulating material between which there are inserted conducting sheets which are screens shaping the electric field in high-voltage electric power equipment is characterized in that the conducting sheets are made of an insulating substrate layer with a porous structure, impregnatable and compressible along the direction parallel to the sheet plane, and at least one surface of the substrate layer has a strongly developed surface and is coated with a metal layer.

14 Claims, 1 Drawing Sheet

INSULATING STRUCTURE WITH SCREENS SHAPING AN ELECTRIC FIELD

TECHNICAL FIELD

The subject of the invention is an insulating structure with screens shaping an electric field, applicable in high-voltage bushings, high-voltage cables, cable accessories and in measuring instruments, especially instrument transformers.

BACKGROUND ART

In high-voltage electric equipment and its components, electric insulation systems are often applied, in which there are placed electrically conductive elements used for shaping the electric field generated by live elements of that equipment or its components. The elements used for shaping the field, placed in insulating material, have typically a form of screens determining the appropriate distribution of the electric field. The appropriate distribution of the electric field is especially important in the construction and operation of high-voltage bushings, high-voltage cables, cable accessories and connection conductors in measuring equipment such as current, voltage or combined instrument transformers. Screens for shaping electric fields usually have the form of conductive sheets placed between layers of insulating material. These sheets are most frequently made of aluminum foil. Sometimes conductive screens made of conductive paper or of fabric that conducts electric current are also used. The insulation material, most frequently made of sheets of insulation paper, is wound together with the conductive screens around a conductor, and then it is impregnated with insulation material in the form of transformer oil or hardenable resin. Usually, before impregnation, the insulating material undergoes a drying process.

In order to obtain an even distribution of the electric field in the cross-section of the insulation structure, conditions ensuring an appropriate voltage distribution among all conductive screens and the maintenance of a constant electric potential throughout the whole surface of each individual screen should be fulfilled. These conditions depend upon the electric capacitance between the screens, the dimensions of the individual screens, their electric impedance, in particular electric resistance, and the maximum frequency at which the appropriate shaping of the electric field is required.

From a British patent description No. GB 991546 there is known a high-voltage insulation structure intended for insulating high-voltage equipment, which contains an insulation skeleton consisting of layers of insulating sheets which are so formed that the overall thickness of a layer is many times the thickness of the basic sheet material and that the sheet material occupies only a fraction of the overall volume of the interior of the skeleton. The space between the insulating and the conductive sheets is filled with a dielectric material. Insulating sheets are made of an absorption material such as paper, which can easily be impregnated with oil or other fluid, or of a non-absorbing material such as a polymer material. Between the insulating layers there are placed conductive sheets, for instance in the form of conductive foil supported on the crests of the corrugations of the corrugated insulating sheet forming the insulation skeleton.

Conductive sheets in the form of metal foil which is placed between layers of an insulating material are widely applied in electric insulating structures. Examples of the use of such insulating structures in various designs of high-voltage bushings are presented in the following patent descriptions: U.S. Pat. Nos. 3,875,327, 4,362,897, 4,338,487, 4,387,266, 4,500,745 and GB 1 125 964.

From a Japanese patent description JP 01283716 there is known a cast bushing in which the conductive sheets are made of fabric or nonwoven cloth having a conductive layer on its surface, e.g. in the form of conductive paint.

Another type of high-voltage insulation is known from application WO2006/001724. In the presented solution a high-voltage bushing is formed by winding layers of electrical insulation material around a cylindrical core. Sheets of conductive material, used for shaping the electric field in the bushing, are placed between those layers. At least one sheet of the conductive material is a structure made on the basis of paper, fabric or nonwoven cloth and it contains conducting particles suspended in it and forming a percolating network, electrically conducting in the sheet plane. The conducting particles have basically an elongated shape and such dimensions that the proportion of their length to the largest crosswise dimension is more than 10.

Metal sheets used as screens for shaping the electric field in high-voltage components in which epoxy resin is used as the insulating material, due to the difference between the coefficients of thermal expansion of metal foil and epoxy resin, cause mechanical stresses that are generated during the process of resin hardening. These stresses persist also after the end of the production process and they manifest themselves especially when such components are operated in very low temperatures.

Conducting sheets made of metal foil are characterized by a typically very high electric conductance. This property in connection with the geometrical arrangement of the sheets in the whole insulation system can result in a generation in that system of electromagnetic resonant oscillations of high frequencies and very large quality factor. Resonance oscillations excited in such systems can cause a local overvoltage leading to insulation damage. Excitation sources triggering such oscillations can emerge in systems comprising semiconductor converters that generate high frequencies, such as systems used in DC voltage transmission, in wind power plants, or in the industrial power systems.

On the other hand, the poor conductivity of paints typically based on carbon materials causes limitations in the use of conducting sheets in the form of such paints in high-voltage equipment, especially in applications in which shaping of the electric field is required for relatively fast transients, such as a lightning impulse or a chopped wave.

Application of conducting sheets made of materials containing conductive particles causes the risk of such particles being released during the process of cutting into suitably shaped sheets. Penetration of such particles into the insulating material can weaken the dielectric properties of the insulating structure.

SUMMARY OF THE INVENTION

The essence of the insulating structure with screens shaping the electric field, comprising layers of an electrically insulating material between which conducting sheets are placed, having a function of screens shaping the electric field in high-voltage electric power equipment, is that the conducting sheets comprise an electrically insulating substrate layer with a structure that is porous, impregnatable and compressible along the direction parallel to the sheet plane, and at least one surface of the substrate layer has a developed surface area greater than its projected surface area and is coated with a metal layer. The thickness of the metal layer is many times smaller than the size of the pores of the porous structure and of the developed surface structure.

In one embodiment the electrically insulating substrate layer has the form of electric grade cellulose insulation paper.

In some embodiments the substrate layer made of cellulose insulation paper is characterized by such porosity that the coefficient of air permeability through the paper is larger than 0.5 μm/(Pa·s).

In some embodiments the electrically insulating substrate layer has the form of unwoven cloth made of polymer fibers.

In some embodiments the electrically insulating substrate layer has the form of a layer of polymer foam with open pores.

In some embodiments the metal layer is substantially made of aluminum, silver, copper, zinc, nickel, tin, titanium or an alloy composed of those metals.

In some embodiments the layers of the electrically insulating material are made of electric grade insulation paper.

In some embodiments the layers of the electrically insulating material are made of a polymeric fabric, preferably a polyester fabric.

In some embodiments the insulating structure with screens shaping the electric field is impregnated with electrically insulating oil.

In some embodiments the insulating structure with screens shaping the electric field is impregnated with a hardenable resin.

In some embodiments the thickness of the metal layer ranges from 5 nm to 200 nm.

In some embodiments the layers of the electrically insulating material are made of at least one band wound around a conductive element.

In some embodiments the insulating structure with screens shaping the electric field is the insulation of a high-voltage bushing.

In some embodiments the insulating structure with screens shaping the electric field is the insulation of a connection conductor of a high-voltage instrument transformer.

BRIEF DESCRIPTION OF THE DRAWINGS

An exemplary embodiment of the invention is presented in the drawing where.

BEST MODE FOR CARRYING OUT THE INVENTION

Figure 1:
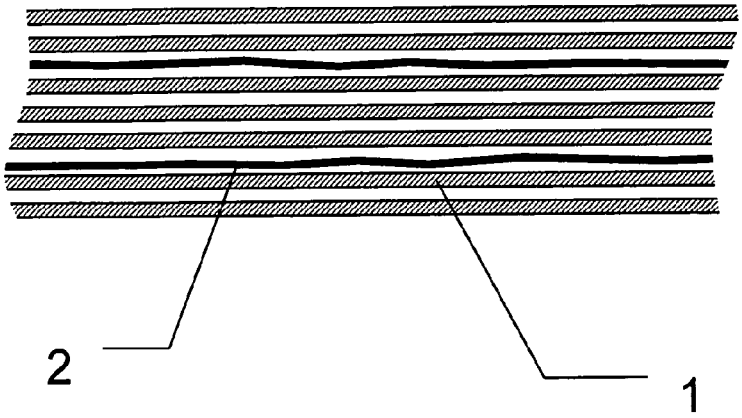
FIG. 1 shows the cross-section of the structure in a plane perpendicular to the surface of the insulating layers and conducting sheets.
Figure 2:
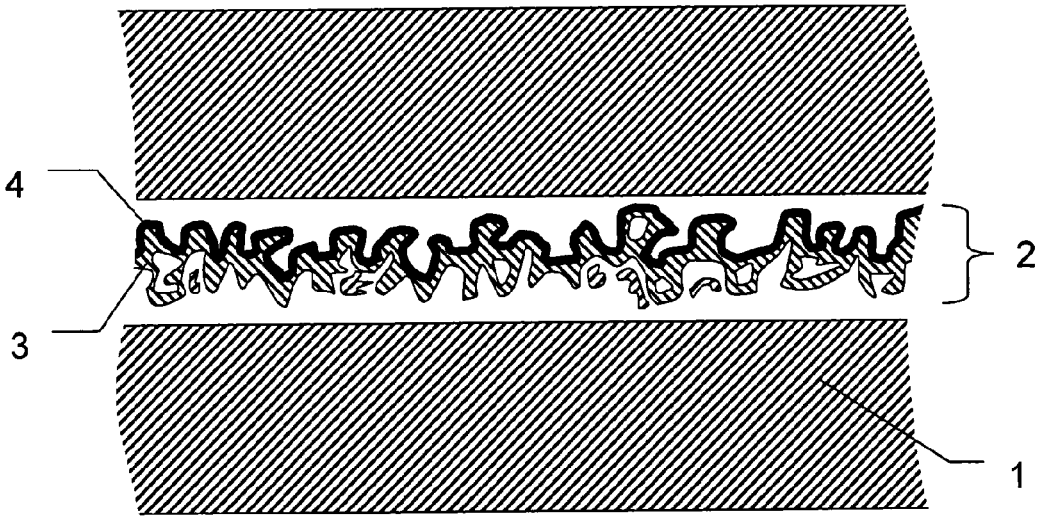
FIG. 2— an enlargement of the section of a conducting sheet and of the layers of the electrically insulating material.

The advantage of the structure according to the invention is the elasticity of the metal layer in the direction parallel to the surface plane of the substrate layer on which it is coated, which is the result of the developed nature of the surface of the metal layer and of the compressibility of the substrate layer permitting for unrestricted thermal expansion and contraction of the whole structure without releasing mechanical stresses.

The effective electric conductivity of the conducting sheet in the form of a metal layer with a specific thickness and developed surface is less than that of a flat surface of the same thickness. Moreover, for a metallic layer in the form of a coating deposited on an insulating substrate layer with a developed surface, the thickness of the metal layer can be much less than for a metal foil. This allows reducing the electric conductivity to a value limiting the quality factor of resonance systems occurring in the given component of equipment, which in turn prevent the occurrence of overvoltages generated by sources of very high frequencies.

At the same time, the use of the metal layer allows to obtain conductivity values much larger than for paints based on carbon materials and sufficient for appropriate shaping the electric field during lightning impulses or chopped waves of required shape.

Cutting the conducting sheets, with the conductive layer in the form of a continuous metal layer, into suitable shapes does not result in releasing of conductive particles at the cut edges, thus greatly reducing the risk of penetration of such particles into the insulating material and weakening the dielectric properties of the insulating structure.

In the embodiment, each of the layers of the electrically insulating material is made of an electric grade cellulose insulation paper 1 of a thickness of 100 μm made into a crepe paper of a total thickness of 0.3 mm to 0.5 mm. Crepe structure of the paper is not shown in the drawing. Conducting sheets 2 consist of an electrically insulating substrate layer in the form of electric grade insulation paper 3 of a thickness of 30 μm to 70 μm and a porous structure, such that the coefficient of air permeability through the paper is not smaller than 0.5 μm/(Pa·s). Alternatively, paper of a thickness of 70 μm to 150 μm and an air permeability coefficient of at least 10 μm/(Pa·s) can be used. Each of the mentioned types of paper is characterized by a strongly developed surface structure created by a mesh of cellulose fibers, and the average size of most of the pores in such paper is within 5 μm to 50 μm. The porous structure of such grades of cellulose paper permits for their compressibility along the direction parallel to the paper sheet plane. One surface of the electric grade insulation paper, constituting the substrate layer, is coated by a 10 nm to 30 nm thick aluminum layer 4, while the surface resistance of the obtained conducting layer is within a range of 1Ω to 10Ω per square.

In the embodiment, the insulating structure forms a winding, not shown in the drawing, around a conductive core, the crepe paper being wound as one band, and the conducting sheets being placed between the layers of the crepe paper. The resultant insulating structure is impregnated with epoxy resin and then hardened. After hardening, the insulating structure is used as the insulating core of a high-voltage bushing.

In another embodiment, the layers of the electrically insulating material of the insulating structure are made of 40 μm to 100 μm thick, smooth winding-type electric grade insulation paper. The conducting sheets are made in the same way as in the previous example. The insulating structure is made in the form of a winding, not shown in the drawing, around one of the conductor connections in a structure of a high-voltage instrument transformer. The insulating structure made in this way, used in an instrument transformer, is then impregnated with electrically insulating oil.

In another embodiment, the layers of the electrically insulating material are made of an electric grade polymeric fabric, for example made of polyester, of a thickness between 50 μm to 500 μm. The conducting sheets are made in the same way as in the previous examples. The insulating structure forms a winding, not shown in the drawing, around a conductive core, the polymeric fabric being wound as one band, and the conducting sheets being placed between the layers of the insulating polymeric fabric. The resultant insulating structure is impregnated with epoxy resin and then hardened. After hardening, the insulating structure is used as the insulating core of a high-voltage bushing.

In another embodiment, the conducting sheets are made of unwoven fabric made of polyester fibers 10 μm to 100 μm thick, and average pore dimensions ranging from 50 μm to 2000 μm. At least one side of the unwoven fabric is coated with a 5 nm to 50 nm thick metallic layer, preferably an aluminum layer, while the layers of the electrically insulating material are made and wound as in one of the previous examples In still another embodiment, the conducting sheets are made of sheets of polyester foam with open pores, a sheet being coated with an aluminum layer at least on one side.

The invention claimed is:

1. An insulating structure with screens shaping the electric field, comprising layers of an electrically insulating material between which conducting sheets are placed, having a function of screens shaping the electric field in high-voltage electric power equipment, wherein the conducting sheets comprise an electrically insulating substrate layer with a structure that is porous, impregnatable and compressible along the direction parallel to the sheet plane, and at least one surface of the substrate layer has a developed surface area greater than its projected surface area and is coated with a metal layer and the thickness of the metal layer is many times smaller than the size of the pores of the porous structure and of the developed surface structure.

2. A structure according to claim 1, wherein the electrically insulating substrate layer has the form of electric grade cellulose insulation paper.

3. A structure according to claim 2, wherein the substrate layer made of cellulose insulation paper is characterized by such porosity that the coefficient of air permeability through the paper is larger than 0.5 μm/(Pa·s).

4. A structure according to claim 1, wherein the electrically insulating substrate layer has the form of unwoven cloth made of polymer fibers.

5. A structure according to claim 1, wherein the electrically insulating substrate layer has the form of a layer of polymer foam with open pores.

6. A structure according to claim 1, wherein the metal layer is substantially made of aluminum, silver, copper, zinc, nickel, tin, titanium or an alloy composed of those metals.

7. A structure according to claim 1, wherein the layers of the electrically insulating material are made of electric grade insulation paper.

8. A structure according to claim 1, wherein the layers of the electrically insulating material are made of a polymeric fabric, preferably a polyester fabric.

9. A structure according to claim 1, wherein the insulating structure with screens shaping the electric field is impregnated with electrically insulating oil.

10. A structure according to claim 1, wherein the insulating structure with screens shaping the electric field is impregnated with a hardenable resin.

11. A structure according to claims claim 1, wherein the thickness of the metal layer ranges from 5 nm to 200 nm.

12. A structure according to claim 1, wherein the layers of the electrically insulating material are made of at least one band wound around a conductive element.

13. A structure according to claim 12, wherein the insulating structure with screens shaping the electric field is the insulation of a high-voltage bushing.

14. A structure according to claim 12, wherein the insulating structure with screens shaping the electric field is the insulation of a connection conductor of a high-voltage instrument transformer.

* * * * *